US006672670B2

(12) United States Patent
Funk et al.

(10) Patent No.: US 6,672,670 B2
(45) Date of Patent: Jan. 6, 2004

(54) PIVOTING ARMREST

(75) Inventors: Nancy A. Funk, Grand Rapids, MI (US); Jeffrey A. Hall, Grand Rapids, MI (US); Robert J. Battey, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/087,520

(22) Filed: Mar. 1, 2002

(65) Prior Publication Data

US 2003/0164638 A1 Sep. 4, 2003

(51) Int. Cl.[7] ..... A47C 7/54
(52) U.S. Cl. ..... 297/411.32
(58) Field of Search ..... 297/411.38, 411.32, 297/377, 378.1, 380, 381, 411.3; 16/251, 250, 228

(56) References Cited

U.S. PATENT DOCUMENTS

| | | | | |
|---|---|---|---|---|
| 939,937 A | | 11/1909 | Winans | |
| 1,312,251 A | | 8/1919 | Jamieson | |
| 2,278,749 A | | 4/1942 | Todd | |
| 2,650,650 A | | 9/1953 | Brown | |
| 2,661,227 A | | 12/1953 | Murphy | |
| 3,316,014 A | | 4/1967 | Barecki | |
| 3,550,958 A | | 12/1970 | Krein | |
| 3,807,799 A | | 4/1974 | Freedman | |
| 4,118,069 A | | 10/1978 | Hunter | |
| 4,176,878 A | | 12/1979 | Koutsky | |
| 4,205,879 A | | 6/1980 | Heling | |
| 4,466,664 A | | 8/1984 | Kondou | |
| 4,586,750 A | | 5/1986 | Vogel | |
| 4,707,032 A | | 11/1987 | Chang | |
| 4,848,840 A | | 7/1989 | Toya | |
| 4,902,072 A | | 2/1990 | Chancellor, Jr. | |
| 5,056,868 A | | 10/1991 | Beck | |
| 5,171,063 A | | 12/1992 | Stidd | |
| 5,314,237 A | | 5/1994 | Koepke et al. | |
| 5,316,373 A | | 5/1994 | Markel | |
| 5,342,115 A | | 8/1994 | De Filippo | |
| 5,395,160 A | | 3/1995 | Krebs et al. | |
| 5,409,297 A | | 4/1995 | De Filippo | |
| 5,597,209 A | | 1/1997 | Bart et al. | |
| 5,720,525 A | | 2/1998 | Rumler | |
| 5,733,010 A | * | 3/1998 | Lewis et al. | 297/452.65 |
| 5,752,291 A | * | 5/1998 | Snyder | 16/235 |
| 5,752,683 A | | 5/1998 | Novis et al. | |
| 5,769,495 A | * | 6/1998 | Vairinen | 297/411.32 |
| 5,823,624 A | | 10/1998 | Dahlbacka | |
| 5,898,471 A | * | 4/1999 | Simioni et al. | 16/235 |
| 6,089,669 A | * | 7/2000 | Wilcox et al. | 351/153 |
| 6,203,101 B1 | | 3/2001 | Chou et al. | 297/411.32 |
| 6,375,265 B1 | * | 4/2002 | Hubner et al. | 297/411.32 |

FOREIGN PATENT DOCUMENTS

| | | | |
|---|---|---|---|
| WO | WO 9428454 A1 * | 12/1994 | G02C/5/22 |

* cited by examiner

*Primary Examiner*—Peter M. Cuomo
*Assistant Examiner*—Stephen D'Adamo
(74) *Attorney, Agent, or Firm*—Price Heneveld Cooper DeWitt & Litton

(57) ABSTRACT

A pivoting armrest assembly for a seating unit includes an armrest support having first and second outer flanges and a center rib, wherein the flanges and the rib define a pair of laterally spaced channels. An arm is pivotally attached to the arm support and has first and second outer ribs that are spaced apart from one another. The pivot attachment is designed to eliminate looseness and bias the arm to one side. When the arm rotates from a vertical to a horizontal position, the first and second outer ribs substantially fill the pair of channels and the center rib intermeshes with the outer ribs, thus eliminating voids and creating a no-pinch condition. The arm and arm support have curved interfacing surfaces that create a self-clearing effect to prevent pinching between a bottom surface of the arm and a front surface of the arm support during rotation of the arm.

31 Claims, 5 Drawing Sheets

PIVOTING ARMREST

BACKGROUND

The present invention relates to a pivoting armrest assembly that can be pivoted between an in use horizontal position and an out of the way vertical position.

Pivoting armrests that allow the arm to be rotated between a horizontal and vertical position for various types of seats are known in the art. In fact, there are a variety of different constructions to achieve the pivoting feature. However, depending on the particular design, the function of a pivoting armrest can result in a number of potential problems for a user.

When a user moves the armrest from a vertical position to a horizontal position, the interaction between the upper arm and the support structure can result in a pinch point where an object can be caught between the arm and the support structure. This is particularly evident with pivoting armrest designs that have a protruding support element adapted to tuck into a cavity in the arm when in the horizontal position. This type of design can create a potential pinch area either by exposing the cavity during movement of the armrest and enabling an object to be caught within the cavity, or by exposing the support structure and allowing objects to be caught thereon when the arm is not in the horizontal position. It is desirable to have a pivoting armrest that does not create the potential pinch areas described above.

Still another concern with a pivoting armrest relates to the robustness of the design. In order to create the pivoting motion, certain clearances must be designed into the pivot joint to allow the arm to pivot freely. In doing this, the pivot connection may develop looseness or "slop" and may result in a rattle noise within the connection. It would be desirable to have a pivoting armrest design that eliminates this type of loose condition.

Accordingly, the inventors have recognized the aforementioned problems and have designed an apparatus having the aforementioned desired advantages.

SUMMARY OF THE INVENTION

In one aspect of the invention, an armrest includes an arm support attached to a seating unit such as a chair. The upper end of the support has outer flanges and a center rib defining a pair of parallel channels. An arm and cushion are pivotally mounted to the arm support. The arm has outer ribs that align with the pair of channels. When the arm is pivoted from the vertical position to the horizontal position, the first and second outer ribs substantially fill the pair of channels. In doing so, any cavities or crevices created in the pivot joint are filled, minimizing any potential pinch area. In a preferred embodiment, the channels are designed with a lateral width that is small enough to allow only very small objects from being inserted into them.

In another aspect of the present invention, an armrest assembly includes an arm support having a forwardly curving front surface. The arm is pivotally attached to the arm support and has a bottom surface that is curved in a downward direction. The front surface of the arm support and bottom surface of the arm are thus curved in opposed directions and relatively convexly towards each other. When the arm is moved between a substantially vertical position and a substantially horizontal position, the angle between the two surfaces remains relatively open. That is to say, that a line drawn at the tangent point on the bottom surface and a line drawn at the tangent point on the front surface at the intersection point of the two surfaces, defines an angle when viewed from the side that does not significantly close. This angle is designed to provide a self-clearing effect and prevent the pinching of objects between the bottom surface and the front surface during rotation of the arm.

In yet another aspect of the present invention, an armrest assembly for a seating unit includes an arm support, and an arm pivotally attached to the arm support. The pivot attachment includes a pivot pin and a bushing. The bushing is pressed onto the pin and the pin is then inserted into aligned apertures on the arm support and arm. The arm also has a counterbore that acts as a stop for the bushing and traps the bushing between the head of the pivot pin and the counterbore. The bushing expands as it is compressed longitudinally during assembly, which creates friction and minimizes looseness within the pivot connection.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
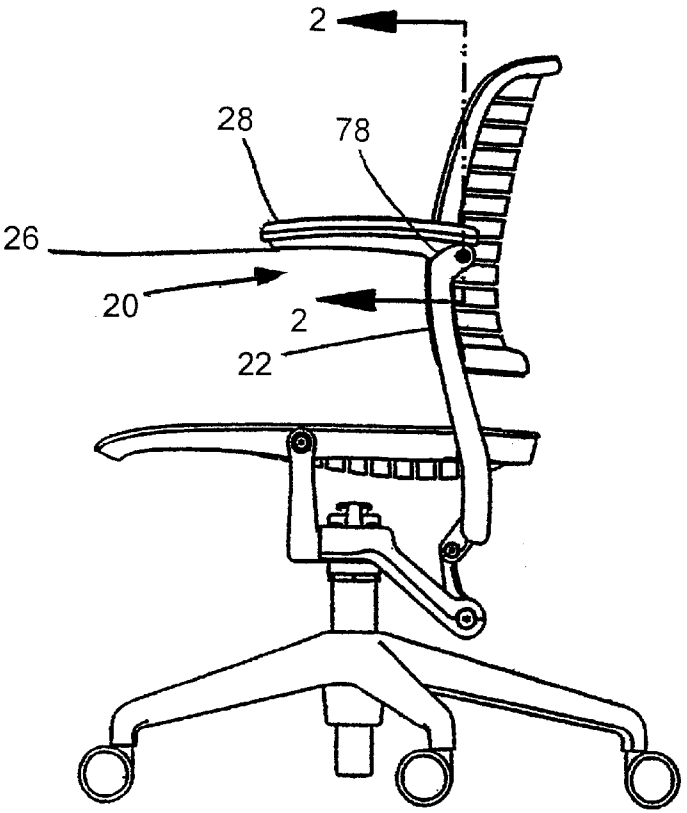
FIG. 1 is a side view of a chair including an armrest assembly embodying the present invention.

For purposes of description herein, the terms "upper," "lower," "right," "left," "rear," "front," "vertical," "horizontal," and derivatives thereof shall relate to the invention as oriented in FIG. 1 from the perspective of a person seated in the chair. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as unnecessarily limiting, unless the claims expressly state otherwise.

Figure 2:
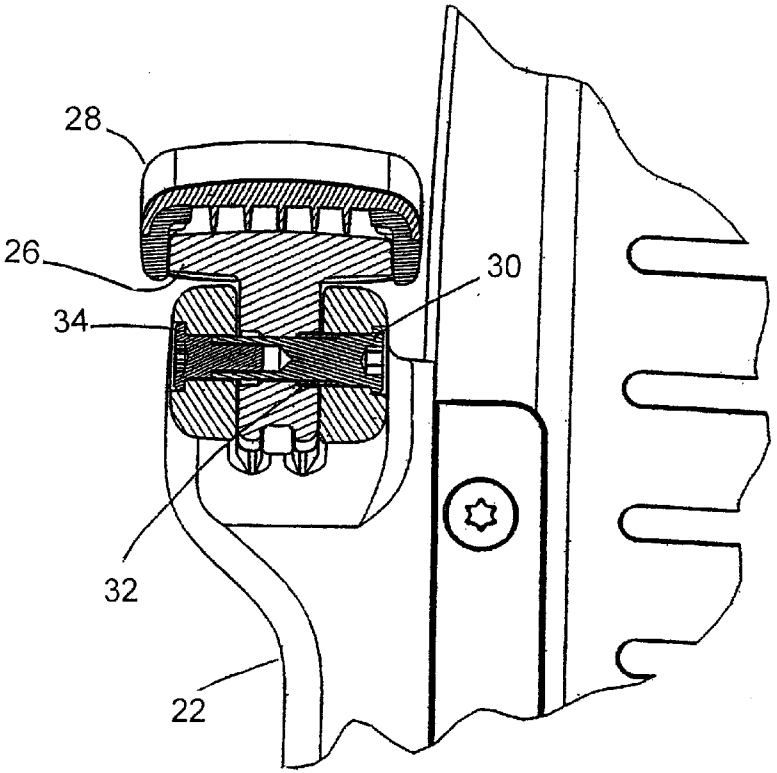
FIG. 2 is a cross-sectional view taken along the line 2—2 in FIG. 1.
Figure 3:
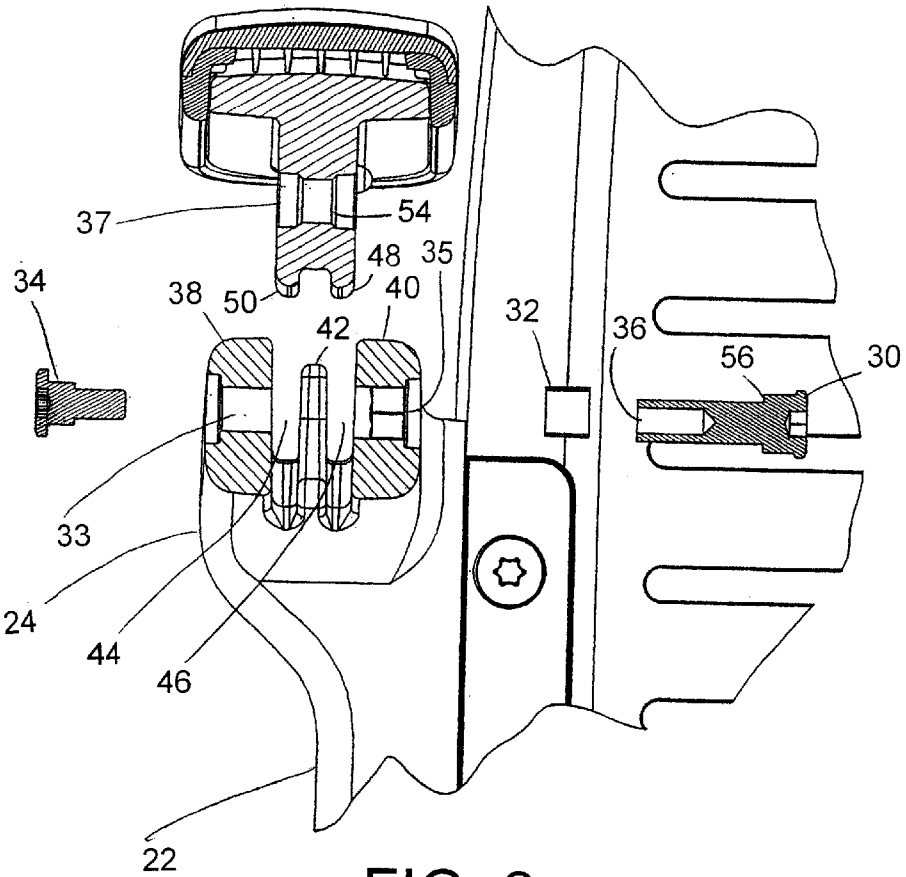
FIG. 3 is an exploded view of FIG. 2.

An armrest assembly 20 (FIGS. 1–3) embodying the present invention includes an armrest support 22 having an upper end 24, an arm assembly including an arm 26, a cushion 28, and a detent system including a plunger 58 and a spring 64. Arm 26 is attached to upper end 24 of arm support 22 by a pivot connection. In the preferred embodiment the arm and arm support are made of a glass filled nylon. The pivot connection includes a pivot pin 30, a bushing 32, and a screw 34 (FIGS. 2 and 3). Bushing 32 is installed on an end of pivot pin 30 and pivot pin 30 is then inserted into aligned apertures 33 and 35 on the arm support and aperture 37 on the arm. Screw 34 is then inserted into aperture 33 and threaded into a cavity 36 on pivot pin 30 to securely hold the pivot connection. Aperture 37 on arm 26 has an internal counterbore 54 (FIG. 3). Bushing 32 is made of a elastomeric material, which allows it to be compressed between counterbore 54 and a head 56 on pivot pin 30 when screw 34 is tightened (FIG. 2). When bushing 32 is compressed, it expands laterally and friction within the pivot connection is increased. When bushing 32 is compressed, the arm is also biased away from head 56 of pivot pin 30 to minimize looseness or "slop" within the pivot connection.

Figure 5:
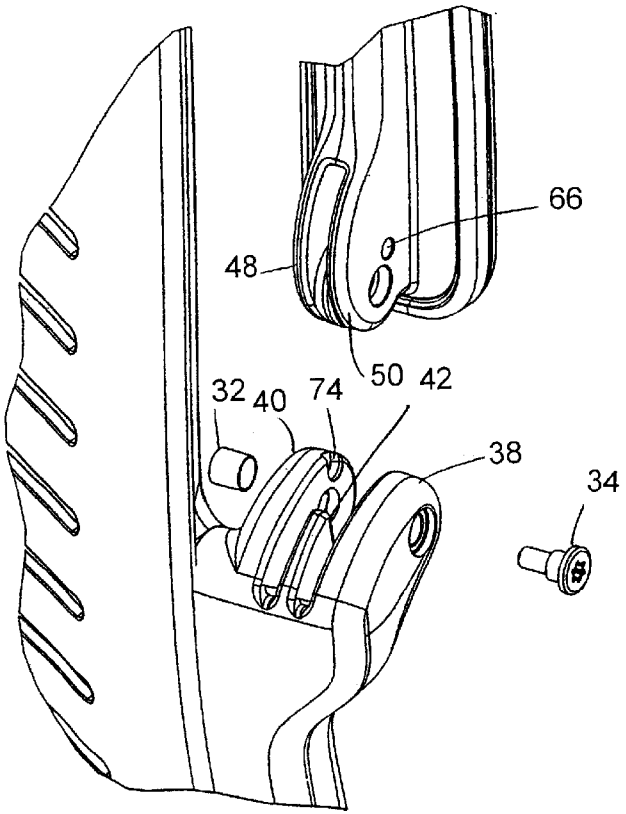
FIG. 5 is an exploded view of the armrest assembly in FIG. 4.
Figure 9:
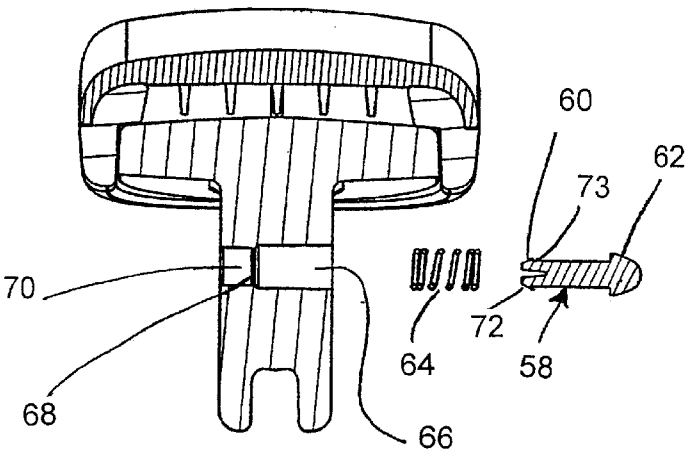
FIG. 9 is an exploded view of FIG. 8.
Figure 7:
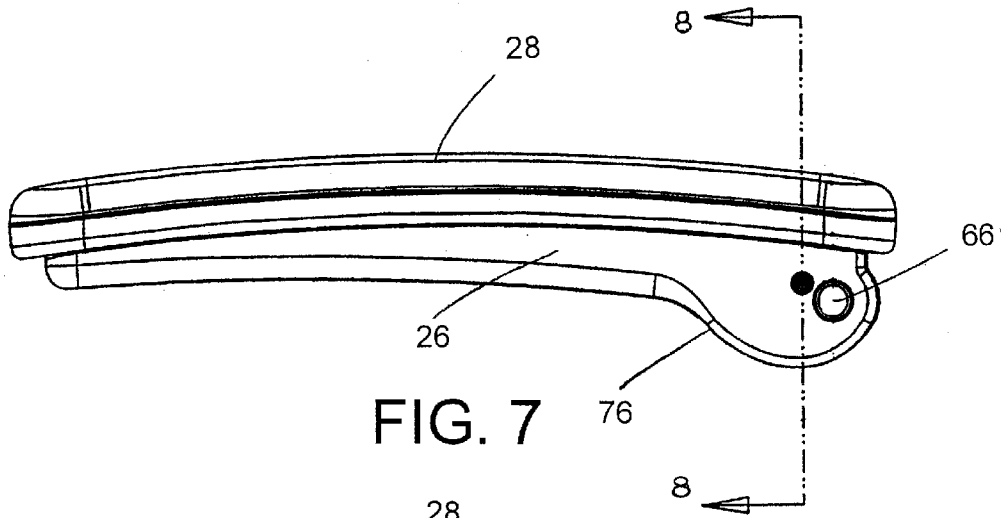
FIG. 7 is a side view of the arm including the plunger assembly and cushion of the armrest of the present invention.
Figure 8:
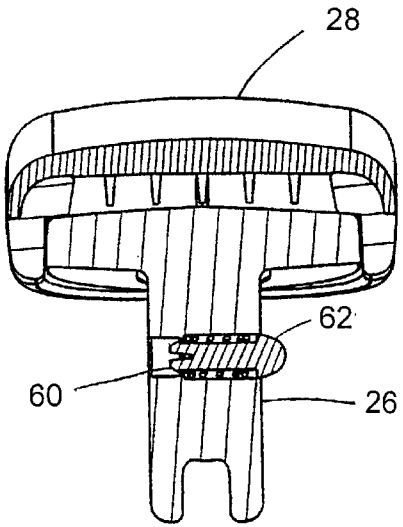
FIG. 8 is a cross-sectional view taken along line 8—8 in FIG. 7.

Armrest assembly 20 further includes a detent system which includes a plunger 58 having a lead end 60 and a bulb end 62, and a spring 64 that is slid on to plunger 58 from lead end 60 in a sleeve-like manner (FIGS. 8 & 9). Plunger 58 and spring 64 fit within a plunger hole 66 on arm 26 (FIGS. 5 & 9). Within plunger hole 66 there is an annular flange 68 defining a smaller internal hole 70. Lead end 60 of plunger 58 has a chamfered tip 72 and a radial flange 73. When the assembled plunger and spring are pushed through plunger hole 66, chamfered tip 72 is able to push through internal hole 70, but radial flange 73 contacts annular flange 68 preventing plunger 58 from being pulled back through and out of internal hole 70.

Figure 11:
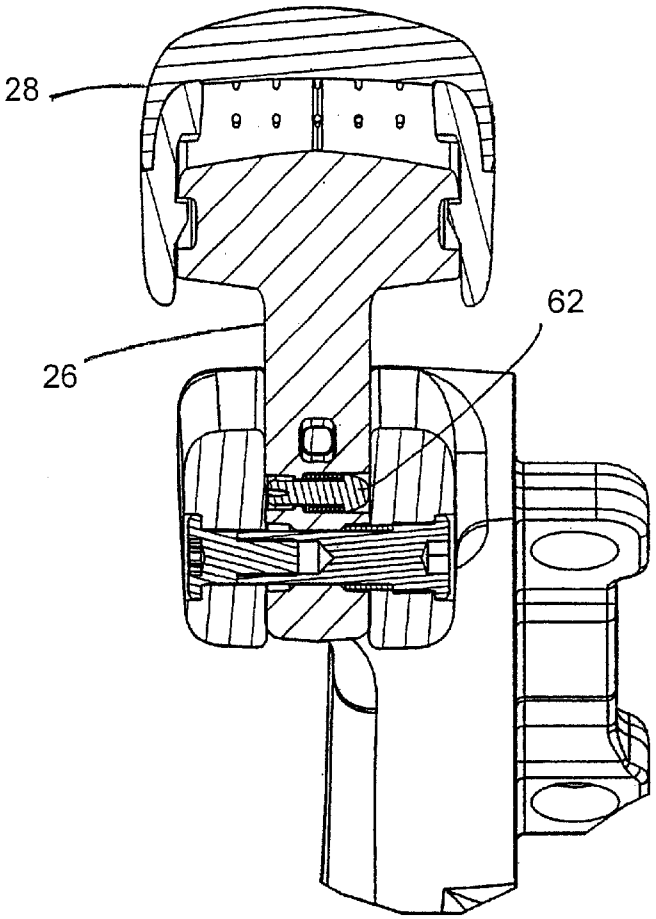
FIG. 11 is a cross-sectional view taken along line 11—11 in FIG. 6 showing the arm in a substantially horizontal position.
Figure 10:
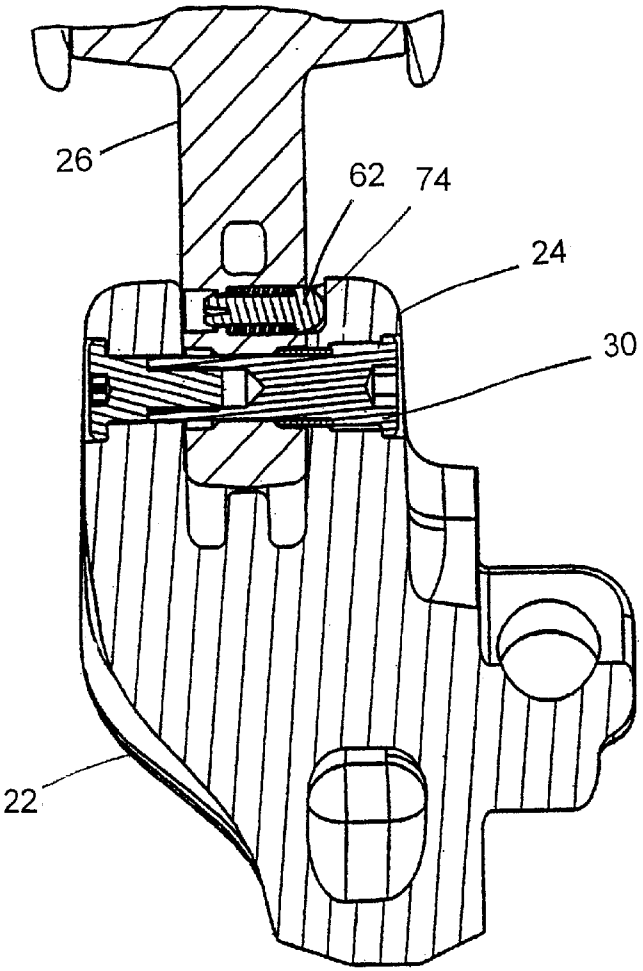
FIG. 10 is a cross-sectional view taken along line 10—10 in FIG. 6 showing the arm in a substantially vertical position.

Arm support 22 has a notch 74 on one of the first and second outer flanges 38 and 40 (FIG. 5). When arm 26 is rotated from a substantially horizontal position to a substantially vertical position, bulb end 62 of plunger 58 moves into notch 74 and holds arm 26 in a substantially vertical or up position (FIG. 10). As bulb end 62 moves into notch 74 there is an audible detent to inform the user that the arm is in the proper up position. When arm 26 is rotated from a substantially vertical position to a substantially horizontal position, bulb end 62 tucks into plunger hole 66 allowing the arm to rotate freely without interference by plunger 58 (FIG. 11).

Figure 4:
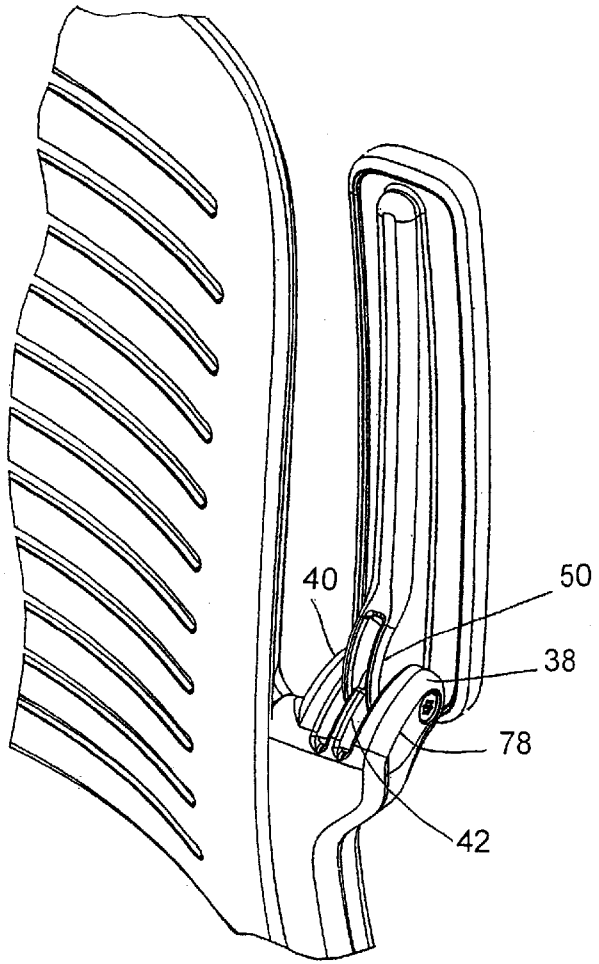
FIG. 4 is a perspective view of the armrest assembly embodying the present invention with the armrest oriented in a substantially vertical position.

Upper end 24 of arm support 22 has first and second outer flanges 38 and 40, and a center rib 42 (FIGS. 3–5). The first and second outer flanges and the center rib define first and second channels 44 and 46. Arm 26 has laterally spaced first and second outer ribs 48 and 50. The arm and arm support are designed such that as the armrest is moved between a substantially horizontal and a substantially vertical position (FIGS. 4 & 6) first and second outer ribs 48 and 50 on arm 26 substantially fill first and second channels 44 and 46 on arm support 22, and center rib 42 on arm support 22 intermeshes with outer ribs 48 and 50 to substantially fill the space between them. In doing so, any cavities or crevices created within the pivot joint are substantially filled and any potential pinch areas are minimized. When the arm is in the substantially horizontal position, channels 44 and 46 and the space between the outer ribs is visible to the user. The channels and space are designed to allow only very small objects to fit within them. In the preferred embodiment, the width of the channels and of the space is preferably ¼ inch or less.

Figure 6:
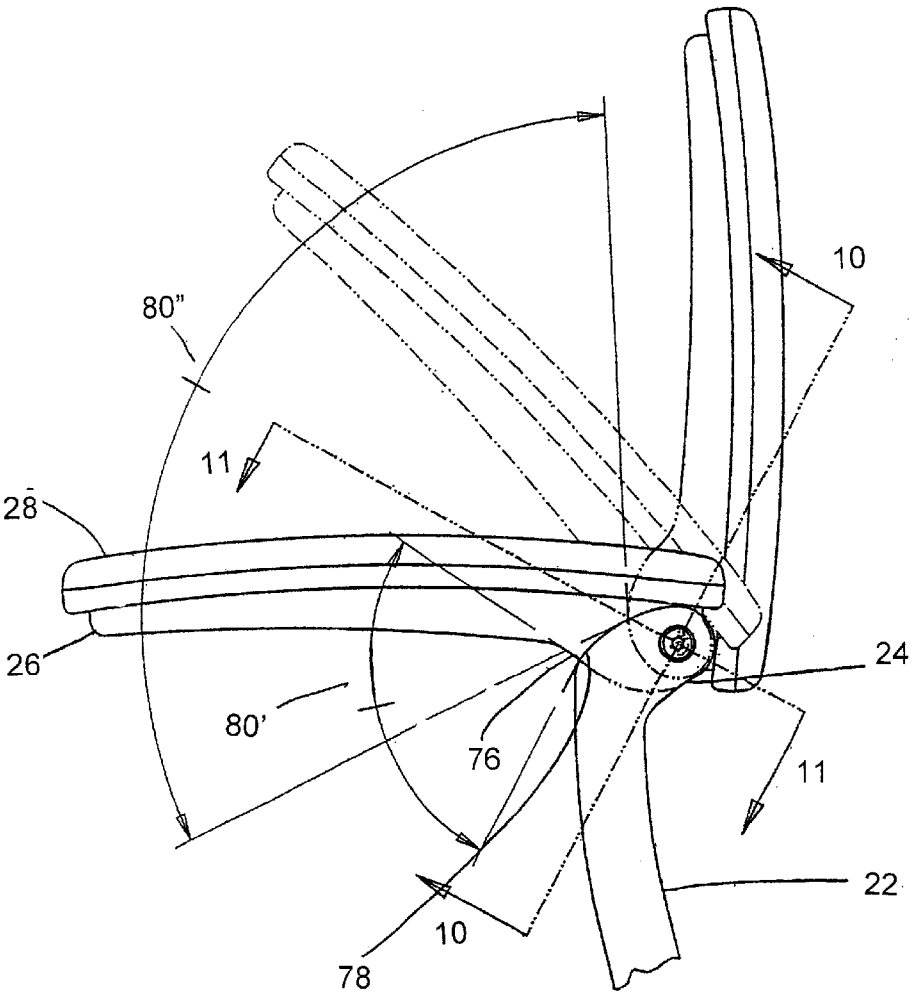
FIG. 6 is a side view of the armrest assembly showing the arm oriented in both a substantially horizontal position and a substantially vertical position and showing the angle created between the arm and arm support.

Armrest assembly 20 further includes a bottom surface 76 on arm 26 that is curved in a downward direction, and a forwardly curving front surface 78 on arm support 22. The curves are designed such that an angle 80 created between bottom surface 76 and front surface 78 at the intersection point of the two curves remains substantially open during movement of the arm (FIG. 6). Viewing armrest 20 from the side, the angle 80 formed by a line drawn at the tangent point on bottom surface 76, and a corresponding line drawn at the tangent point on front surface 78 drawn at the intersection point between the two curves, does not substantially close during rotation of the arm from the vertical to horizontal position. Bottom surface 76 and front surface 78 are curved in opposed directions and curved relatively convex towards each other so that, as the intersection point moves along the surfaces during rotation of the armrest, the surfaces diverge from one another and angle 80 formed by the tangent lines remains open. When arm 26 is oriented to the substantially horizontal position angle 80' is slightly smaller than angle 80" when arm 26 is oriented to the substantially vertical position (FIG. 6). In both the substantially vertical and substantially horizontal positions, angle 80 is at least 90 degrees and preferably at least 95 degrees throughout the range of motion for the arm. Although the angle may be slightly smaller in one position or the other, a self-clearing condition is created between arm 26 and arm support 22 by never allowing the angle to be reduced below this optimal minimum. The self-clearing effect is essentially where the two surfaces are never in such a relationship to one another so as to create an angle between them small enough to be able to "grab" or pinch an object between them. Instead, the relationship between the two surfaces actually "pushes-out" or "self-clears" objects away from the intersection point.

The armrest assembly of the present invention is designed such that a seated user can position the arms in a substantially horizontal position for use as a support for the user's arm. The armrest is then repositionable to a substantially vertical position so that the user can move the arms up and out of the way if so desired.

In the foregoing description, those skilled in the art will readily appreciate that modifications may be made to the invention without departing from the concepts disclosed herein. Such modifications are to be considered as included in the following claims, unless these claims by their language expressly state otherwise.

The invention claimed is defined as follows:

1. An armrest assembly comprising:

an arm support having an upper end, said upper end including first and second outer flanges and a center rib, said flanges and said center rib defining first and second channels;

an arm pivotally attached to said arm support and having first and second outer ribs spaced apart from one another, said first outer rib fitting into said first channel and said second outer rib fitting into said second channel;

wherein said armrest can be oriented between a substantially vertical position and a substantially horizontal position, and when said armrest is moved between said substantially vertical and said substantially horizontal positions, said first and second outer ribs substantially fill said first and second channels and said center rib substantially fills said space between said outer ribs; and wherein when viewed from the side, the angle created at the intersection point of the two surfaces remain relatively open as said arm moves from said substantially vertical position toward said substantially horizontal so as to provide a self-clearing effect during rotation of the arm.

2. An armrest assembly as set forth in claim 1 including a pivot attachment pivotally supporting the arm on the arm support, the pivot attachment including a pivot pin having a head, and a bushing pressed on to said pivot pin.

3. An armrest assembly as set forth in claim 2, wherein said bushing is made of urethane.

4. An armrest assembly as set forth in claim 2, wherein said pivot pin and said bushing are inserted into aligned apertures on said arm and said arm support, said aperture on said arm having an internal counterbore, wherein said bushing is compressed between said counterbore and said head on said pivot pin such that friction is increased and said arm is biased to one side to minimize looseness within the pivot connection.

5. An armrest assembly comprising:

an arm support having an upper end, said upper end including first and second outer flanges and a center rib, said flanges and said center rib defining first and second channels;

an arm pivotally attached to said arm support and having first and second outer ribs spaced apart from one another, said first outer rib fitting into said first channel and said second outer rib fitting into said second channel; and wherein said armrest can be oriented between a substantially vertical position and a substantially horizontal position, and when said armrest is moved between said substantially vertical and said substantially horizontal positions, said first and second outer ribs substantially fill said first and second channels and said center rib substantially fills said space between said outer ribs;

a pivot attachment including a pivot pin having a head, and a bushing pressed on to said pivot pin and said bushing being made of urethane;

said pivot pin and said bushing are inserted into aligned apertures on said arm and said arm support, said aperture on said arm having an internal counterbore, wherein said bushing is compressed between said counterbore and said head on said pivot pin such that friction is increased and said arm is biased to one side to minimize looseness within the pivot connection;

a plunger spaced radially from said pivot pin and having a lead end and a bulb end, said lead end having a chamfered tip and a radial flange;

a spring slipped on to said plunger in a sleeve-like manner from said lead end, wherein said plunger and spring are inserted into a plunger hole on said arm, said plunger hole having an annular flange defining a smaller diameter internal hole; and wherein said plunger is pushed through said plunger hole and said chamfered tip can be pushed through said internal hole, but said radial flange on said plunger contacts said annular flange in said plunger hole and prevents said plunger from being pulled back through and out of said internal hole.

6. An armrest assembly as set forth in claim 5, further comprising a cushion attached to said arm.

7. An armrest assembly as set forth in claim 5, wherein said first and second channels are parallel.

8. An armrest assembly as set forth in claim 5, wherein said arm support further includes a notch, wherein said bulb end is moved into said notch when said arm is moved into said substantially vertical position.

9. An armrest assembly as set forth in claim 8, wherein as said bulb end moves into said notch there is an audible detent to inform the user that the arm is in the proper up position.

10. An armrest assembly comprising:

an arm support having an upper end, said upper end including first and second outer flanges and a center rib, said flanges and said center rib defining first and second channels;

an arm pivotally attached to said arm support and having first and second outer ribs spaced apart from one another, said first outer rib fitting into said first channel and said second outer rib fitting into said second channel; and wherein said armrest can be oriented between a substantially vertical position and a substantially horizontal position, and when said armrest is moved between said substantially vertical and said substantially horizontal positions, said first and second outer ribs substantially fill said first and second channels and said center rib substantially fills said space between said outer ribs, wherein said arm support has a forwardly curving front surface and said arm has a downwardly curving bottom surface forming an angle, wherein said bottom surface of said arm and said front surface of said arm support are curved in opposed directions, relatively convexly towards each other; and when viewed from the side, the angle created at the intersection of the two surfaces remains relatively open as said arm moves from said substantially vertical position toward said substantially horizontal position so as to provide a self-clearing effect during rotation of the arm.

11. An armrest assembly as set forth in claim 10, wherein said angle is at least 90 degrees during rotation of said arm between said horizontal and said vertical position.

12. An armrest assembly as set forth in claim 11, wherein said angle is at least 95 degrees during rotation of said arm between said horizontal and said vertical position.

13. A pivoting armrest assembly, comprising:

an arm support;

an arm pivotally attached to said arm support, a pivot attachment including aligned apertures on said arm and said arm support, a pivot pin having a head, and a bushing pressed on to said pivot pin, said aperture on said arm having an internal counterbore, wherein said bushing is compressed between said counterbore and said head on said pivot pin such that friction is increased and said arm is biased away from said head to minimize looseness within the pivot connection;

wherein said arm can be oriented between a substantially vertical position and a substantially horizontal position;

a detent feature to position said arm in said substantially vertical position, said detent feature including a notch and plunger assembly, said notch and plunger assembly being spaced radially from said pivot pin;

said plunger having a lead end and a bulb end, said lead end having a chamfered tip and a radial flange;

a spring is slipped on to said plunger in a sleeve-like manner from said lead end, wherein said plunger and spring are inserted into a plunger hole on said arm, said plunger hole having an annular flange defining a smaller diameter internal hole, and wherein said plunger is pushed through said plunger hole and said chamfered tip can be pushed through said internal hole, but said radial flange on said plunger contacts said annular flange in said plunger hole and prevents said plunger from being pulled back through and out of said internal hole.

14. A pivoting armrest assembly as set forth in claim 13, further including a cushion attached to said arm.

15. A pivoting armrest assembly as set forth in claim 13, wherein said bulb end is moved into said notch when said arm is moved from said substantially horizontal position to said substantially vertical position.

16. A pivoting armrest assembly as set forth in claim 15, wherein as said bulb end moves into said notch there is an audible detent to inform the user that said arm is in the proper up position.

17. A pivoting armrest assembly as set forth in claim 13, wherein said arm support further includes an upper end, said upper end including first and second outer flanges and a center rib, said flanges and said center rib defining first and second channels;

said arm including first and second outer ribs spaced apart from one another, said first outer rib fitting into said first channel and said second outer rib fitting into said second channel; and wherein as said armrest is pivoted between said substantially horizontal and substantially vertical positions said first and second outer ribs substantially fill said first and second channels and said center rib substantially fills said space between said outer ribs.

18. A pivoting armrest assembly as set forth in claim 17, wherein said first and second channels are parallel.

19. An armrest assembly, comprising:

an arm support having a forwardly curving front surface;

an arm pivotally attached to said arm support, said arm having a downwardly curving bottom surface forming an angle, wherein said bottom surface of said arm and said front surface of said arm support are curved in opposed directions, relatively convexly towards each other; and wherein said arm can be oriented between a substantially horizontal and a substantially vertical position, and when viewed from the side, the angle created at the intersection point of the two surfaces remains relatively open as said arm moves from said substantially vertical position toward said substantially horizontal position so as to provide a self-clearing effect during rotation of the arm.

20. An armrest assembly as set forth in claim 19, wherein said angle is at least 90 degrees during rotation of said arm between said horizontal and said vertical position.

21. An armrest assembly as set forth in claim 20, wherein said angle is at least 95 degrees during rotation of said arm between said horizontal and said vertical position.

22. An armrest assembly as set forth in claim 20, wherein the arm is pivoted to the arm support by a pivot attachment that includes a pivot pin having a head, and a bushing on the pivot pin and compressed against the head.

23. An armrest assembly as set forth in claim 22, wherein said bushing biases said arm to one side.

24. An armrest assembly as set forth in claim 23, wherein said pivot pin and said bushing are inserted into aligned apertures on said arm support and an aperture on said arm, said aperture on said arm having an internal counterbore, wherein said bushing is compressed between said counterbore and said head on said pivot pin such that friction is increased and looseness within the pivot connection is minimized.

25. An armrest assembly, comprising:

an arm support having a forwardly curving front surface;

an arm pivotally attached to said arm support, said arm having a downwardly curving bottom surface, wherein said bottom surface of said arm and said front surface of said arm support are curved in opposed directions, relatively convexly towards each other; and wherein said arm can be oriented between a substantially horizontal and a substantially vertical position, and when viewed from the side, the angle created at the intersection point of the two surfaces remains relatively open as said arm moves from said substantially vertical position toward said substantially horizontal position so as to provide a self-clearing effect during rotation of the arm;

wherein said angle is at least 90 degrees during rotation of said arm between said horizontal and said vertical position;

wherein a pivot attachment for connecting the arm to the arm support includes a pivot pin having a head, and a bushing that biases said arm to one side;

wherein said pivot pin and said bushing are inserted into aligned apertures on said arm support and an aperture on said arm, said aperture on said arm having an internal counterbore, wherein said bushing is compressed between said counterbore and said head on said pivot pin such that friction is increased and looseness within the pivot connection is minimized; and a plunger having a lead end and a bulb end, said lead end having a chamfered tip and a radial flange, and further including a spring inserted over said plunger from the lead end, wherein said plunger and said spring are inserted into a hole on said arm, said hole having an annular flange defining a smaller diameter internal hole, wherein when said plunger is inserted through said internal hole said chamfered tip can push through said internal hole, but said radial flange contacts said annular flange and prevents said plunger from being pulled back through said internal hole.

26. An armrest assembly as set forth in claim 25 further comprising a cushion attached to said arm.

27. An armrest assembly as set forth in claim 25, wherein said arm support further includes a notch, wherein said bulb end is moved into said notch when said arm is moved from said substantially horizontal position to said substantially vertical position.

28. An armrest assembly as set forth in claim 27, wherein as said bulb end moves into said notch there is an audible detent to inform the user that the arm is in the proper up position.

29. An armrest assembly as set forth in claim 28, wherein said arm support further includes an upper end, said upper end including first and second outer flanges and a center rib, said flanges and said center rib defining first and second channels;

said arm further including first and second outer ribs spaced apart from one another, said first outer rib fitting into said first channel and said second outer rib fitting into said second channel; and wherein when said armrest is pivoted between said substantially horizontal and substantially vertical positions said first and second outer ribs substantially fill said first and second channels and said center rib substantially fills said space between said outer ribs.

30. An armrest assembly as set forth in claim 29 wherein said first and second channels are parallel.

31. An armrest assembly, comprising:

an arm support having a forwardly curving front surface;

an arm pivotally attached to said arm support, said arm having a downwardly curving bottom surface forming an angle, wherein said bottom surface of said arm and said front surface of said arm support are curved in opposed directions, relatively convexly towards each other; and wherein said arm can be oriented between a substantially horizontal and a substantially vertical position, and when viewed from the side, the angle created at the intersection point of the two surfaces remains relatively open as said arm moves from said substantially vertical position toward said substantially horizontal position so as to provide a self-clearing effect during rotation of the arm; and a plunger having a lead end and a bulb end, said lead end having a chamfered tip and a radial flange, and further including a spring inserted over said plunger from the lead end, wherein said plunger and said spring are inserted into a hole on said arm, said hole having an annular flange defining a smaller diameter internal hole, wherein when said plunger is inserted through said internal hole said chamfered tip can push through said internal hole, but said radial flange contacts said annular flange and prevents said plunger from being pulled back through said internal hole.

* * * * *